US009403541B2

(12) United States Patent
Henrici

(10) Patent No.: US 9,403,541 B2
(45) Date of Patent: Aug. 2, 2016

(54) PORTABLE RAILCAR SILL STEP EXTENDER

(71) Applicant: Christian M. Henrici, Batavia, NY (US)

(72) Inventor: Christian M. Henrici, Batavia, NY (US)

( * ) Notice: Subject to any disclaimer, the term of this patent is extended or adjusted under 35 U.S.C. 154(b) by 213 days.

(21) Appl. No.: 14/331,493

(22) Filed: Jul. 15, 2014

(65) Prior Publication Data

US 2015/0027341 A1 Jan. 29, 2015

Related U.S. Application Data

(60) Provisional application No. 61/857,925, filed on Jul. 24, 2013.

(51) Int. Cl.
*B61D 23/00* (2006.01)

(52) U.S. Cl.
CPC ..... *B61D 23/00* (2013.01)

(58) Field of Classification Search
CPC ..... B60R 3/007; B60R 9/06; B60R 3/00; B60R 3/02; B60R 9/10; B61D 23/00; B62B 5/067; B62B 2205/006; E06C 7/16; E06C 1/36; E06C 1/38; E06C 7/02; E06C 9/06
USPC ..... 105/443
See application file for complete search history.

(56) References Cited

U.S. PATENT DOCUMENTS 3,046,827 A * 7/1962 Myers ..... F16B 21/165 24/453
5,082,037 A * 1/1992 Hammons ..... B60R 9/06 144/286.1
5,114,260 A * 5/1992 Hart ..... F16G 15/06 403/154
5,799,961 A * 9/1998 Schmeets ..... E06C 5/00 182/92
7,828,118 B2 11/2010 Barbara
7,849,962 B2 12/2010 Barbara

* cited by examiner

*Primary Examiner* — Mark Le
(74) *Attorney, Agent, or Firm* — Tracy Jong Law Firm; Tracy P. Jong; Cheng Ning Jong

(57) ABSTRACT

A portable railcar sill step extender adapted to a sill step of a railcar, the portable railcar step comprising an elongated member having two longitudinal ends and two substantially parallel surfaces, a first receptacle disposed on a first plane substantially parallel to the two substantially parallel surfaces, a second receptacle disposed on a second plane, the second plane disposed at from about 8 degrees to about 12 degrees from the two substantially parallel surfaces and a locking device. Each of the first receptacle and the second receptacle is adapted to receive the sill step and the locking device is adapted to be removably applied at one of the first receptacle and the second receptacle to prevent the elongated member from sliding off of the sill step in a longitudinal direction of the elongated member.

19 Claims, 9 Drawing Sheets

PORTABLE RAILCAR SILL STEP EXTENDER

PRIORITY CLAIM AND RELATED APPLICATIONS

This non-provisional application claims the benefit of priority from provisional application U.S. Ser. No. 61/857,925 filed on Jul. 24, 2013. Said application is incorporated by reference in its entirety.

BACKGROUND OF THE INVENTION

1. The Field of the Invention

The present invention is directed generally to a portable railcar sill step extender. More specifically, the present invention is directed to a portable railcar sill step extender that is adaptable to a damaged or undamaged railcar sill step.

2. Background Art

A railcar is a railway vehicle that is adapted to travel on the rails of a railway and is largely used for hauling materials. Railcars are typically coupled together to form a train and are hauled by a locomotive. In placing railcars at destinations or a rail yard such that their contents can be unloaded or new contents loaded, in order to avoid having to walk distances, rail workers typically ride onboard railcars by standing on a sill step and clinging onto one or more handholds disposed above the sill step. Sill steps are typically mounted on the sides of a railcar and near each corner of the railcar and provided as steps for placing ones' feet at a height between the lowest handhold and the ground. A sill step is typically constructed in the form of a U-shaped structure from substantially flat metal stock. The handholds are provided for an operator to grip while ascending or descending a sill step. A rail worker may stand on a sill step and hold onto a handhold of a railcar as the railcar is transported around a rail yard. A sill step is typically mounted inward of a railcar, i.e., between side walls of the railcar so as to avoid protruding into objects disposed along the travel path of the railcar. Consequently, the rail worker must lean outward at an angle, making for an uncomfortable and non-ergonomic posture. Attempts have been previously made to alleviate these problems.

U.S. Pat. No. 7,849,962 and U.S. Pat. No. 7,828,118 (hereinafter Barbara) disclose a rail vehicle step configured to be mounted to a sill step of a rail vehicle in an attempt to solve such problems. In Barbara, a support is sized and adapted to a sill step to support a rail worker. A coupling is sized and configured to hold the support in fixed relation to the sill step. The support is sized to extend outward beyond the side walls of a rail vehicle and support a rail worker. Various disadvantages are associated with Barbara's support.

Barbara discloses a clamp type securing means that is complex. The securing means includes a screw (100 of Barbara) and ratchet structure (104 of Barbara) and causes unnecessary hauling of extra weights while not enabling positive locking of Barbara's step to the sill step of a railcar. The capability of positively locking a support onto a sill step is especially important considering the vibration that can potentially dislodge the securement of Barbara's support placed on the sill step. In addition, the contact surface of Barbara's screw (100 of Barbara) and a sill step is minimal at best. It is also difficult to realize when Barbara's support is sufficiently secured to a sill step as Barbara's screw may be made of materials of similar hardness to a sill step and therefore lacking the deformation in at least one of the two parts to generate sufficient grip to prevent relative motion between the two parts. Further, Barbara's step is incapable of being adapted to deformed sill steps of railcars to result in a leveled support for a rail worker as Barbara's support is only capable of forming a support having a stepped on surface that is substantially parallel with the sill step to which it is attached.

Thus, there arises a need for a portable railcar sill step extender that is capable of being positively secured onto both undamaged and deformed sill steps without unnecessary adjustments and alignments.

SUMMARY OF THE INVENTION

The present invention is directed toward a portable railcar sill step extender adapted to a sill step of a railcar, the portable railcar sill step extender including:

(a) an elongated member having two longitudinal ends and two substantially parallel surfaces, a first receptacle having at least one slot adapted to receive the sill step, the first receptacle is disposed on a first plane substantially parallel to the two substantially parallel surfaces and on one of the two longitudinal ends, a second receptacle having at least one slot adapted to receive the sill step, the second receptacle is disposed on a second plane disposed at from about 8 degrees to about 12 degrees from the two substantially parallel surfaces and on the other one of the two longitudinal ends; and (b) a locking mechanism including a bolt configured to removably connect the two substantially parallel surfaces to form a removable connection at one of the first and second receptacles upon one of the at least one slot of the first and second receptacles receiving the sill step to prevent the elongated member from sliding off of the sill step in a longitudinal direction of the elongated member once the sill step has been received in one of the first receptacle and the second receptacle.

Any one of the at least one slot of the first receptacle and the at least one slot of the second receptacle includes a first slot and a second slot, where the first slot is adapted to accommodate the sill step size of about ¾ inches thick and the second slot is adapted to accommodate the sill step size of about 0.5 inches thick.

In one embodiment, the elongated member further comprises at least one aperture on each of the two substantially parallel surfaces to enable removable bridging of the two substantially parallel surfaces.

In one embodiment, the locking mechanism includes a twist handle screw-locking ring combination.

In another embodiment, the locking mechanism includes a spring locking pin-bolt combination and a quick release ball lock pin.

In one embodiment, there is provided a locking ring configured to removably encompass one of the two longitudinal ends of the elongated member in order to prevent the spread of the two substantially parallel surfaces in a direction away from one another.

In one embodiment, the elongated member further includes a pair of side walls and the portable railcar sill step extender further includes a platform system having a platform and a pair of side plates disposed at substantially right angle to the platform. The pair of side plates is configured for removable attachment to the pair of side walls.

Accordingly, it is a primary object of the present invention to provide a portable step that is lightweight, simple in its construction and capable of being positively secured to a railcar sill step.

It is another object of the present invention to provide a portable step that is adaptable to both undamaged and deformed sill steps.

It is another object of the present invention to provide a portable step that is adaptable to sill steps of various sizes.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
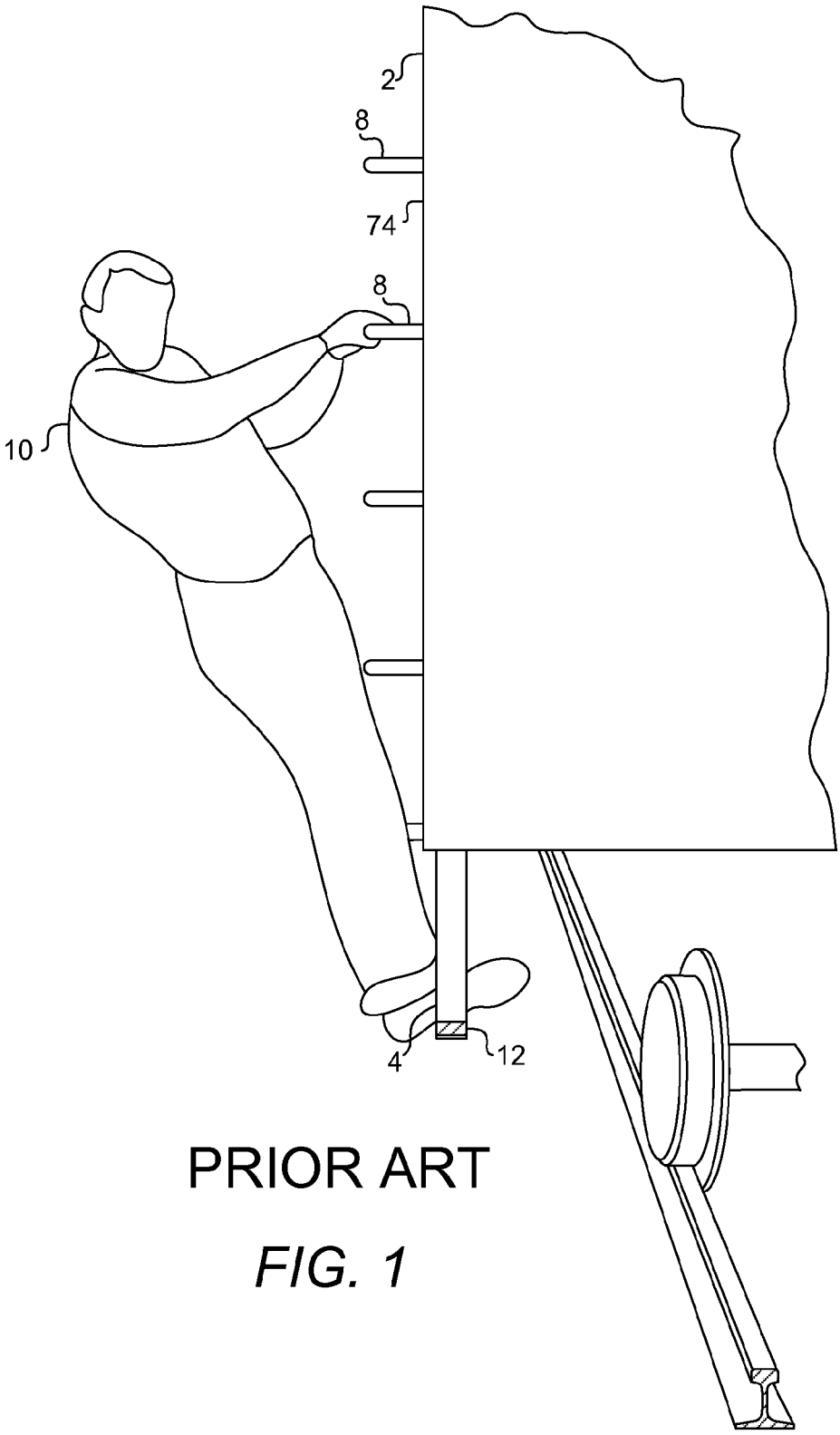
PRIOR ART FIG. 1
FIG. 1 is a partial environmental rear elevational view of a prior art railcar step.

2—railcar
4—railcar ladder
6—through aperture
8—handhold
10—user or railcar worker
12—sill step
14—portable railcar sill step extender
16—square receptacle
18—slanted receptacle
20—large slot
22—small slot
24—through aperture for accommodating locking device
26—locking device or twist handle screw
28—nut
30—hole
32—longitudinal end of portable railcar sill step extender
34—stepped on surface or substantially parallel surfaces
36—height of large slot
38—height of small slot
40—total height of portable railcar sill step extender
42—threaded end of twist handle screw
44—bolt
46—spring locking pin
48—threaded aperture
50—locking ring
52—length of portable railcar sill step extender
54—jaw
56—direction in which weight of railcar worker is applied
58—relative angle between slanted receptacle and stepped on surface
60—first plane
62—second plane
64—quick release ball lock pin
66—shaft of quick release ball lock pin
68—button of quick release ball lock pin
70—retaining ball of quick release ball lock pin
72—handhold of quick release ball lock pin
74—side wall of railcar
76—width of stepped on surface
78—platform system
80—platform
82—securing side plate
84—fastener
86—washer
88—side wall of portable railcar sill step extender

PARTICULAR ADVANTAGES OF THE INVENTION

The present portable step extender is lightweight, simple in its construction and capable of being positively secured to a railcar sill step. Positive securement of a step extender to a sill step is critical as the contrary is prone to dislodgement from the sill step during use and can cause the user of the step to accidently lose his perch and cause injuries. In addition, in one embodiment, a locking ring and a twist handle screw are provided. The locking ring is configured to slide over the longitudinal end of the present extender that is adapted to a sill step and be locked in place using a twist handle screw.

The present portable step is adaptable to both undamaged and deformed sill steps. An undamaged sill step is typically aligned horizontally with a broad surface facing upwardly to support a user. Permanent deformations can occur to a sill step where it is accidentally impacted with environmental features such as pylons, walls, guard rails, etc. Such deformations may cause at least a portion of a sill step to deviate from a horizontal orientation. The present portable step is configured such that it is capable of being adapted to such sill step to form a substantially horizontal platform on which a user is supported.

The present extender is capable of being adapted to sill steps of at least two different sizes. Barbara offers such a feature but in contrast, does so at the expense of not allowing positive locking of its step on a sill step.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 2:
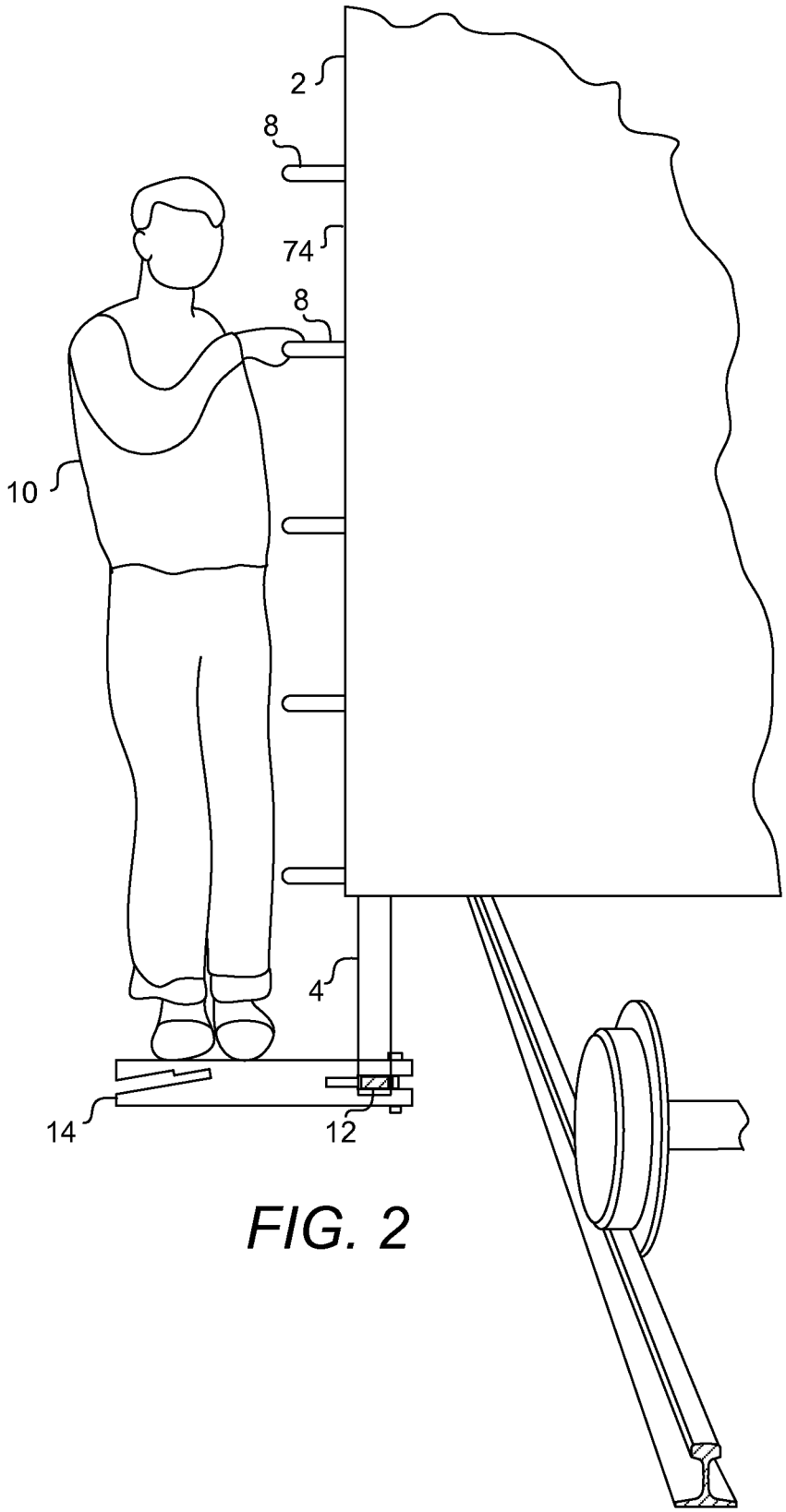
FIG. 2 is a partial environmental rear elevational view of a railcar sill step extender according to one embodiment of the present invention.

FIG. 1 is a partial environmental rear elevational view of a prior art railcar sill step. It shall be apparent from this figure that such sill step is configured approximately as an extension from a side wall of a railcar 2. Consequently, the rail worker 10 must lean outwardly at an angle from a side wall 74 of a railcar while clinging onto the side of the railcar by holding onto at least one handhold 8 mounted to the side wall of the railcar, making for an uncomfortable and non-ergonomic posture. FIG. 2 is a partial environmental rear elevational view of a railcar sill step extender according to one embodiment of the present extender 14. It shall be noted that, compared to the rail worker 10 of FIG. 1, the posture of the rail worker 10 of FIG. 2 appears more natural and comfortable. The railcar worker's weight is applied substantially vertically on the step extender 14, eliminating any chances of stress concentration on a part of the rail worker's body.

Figure 3:
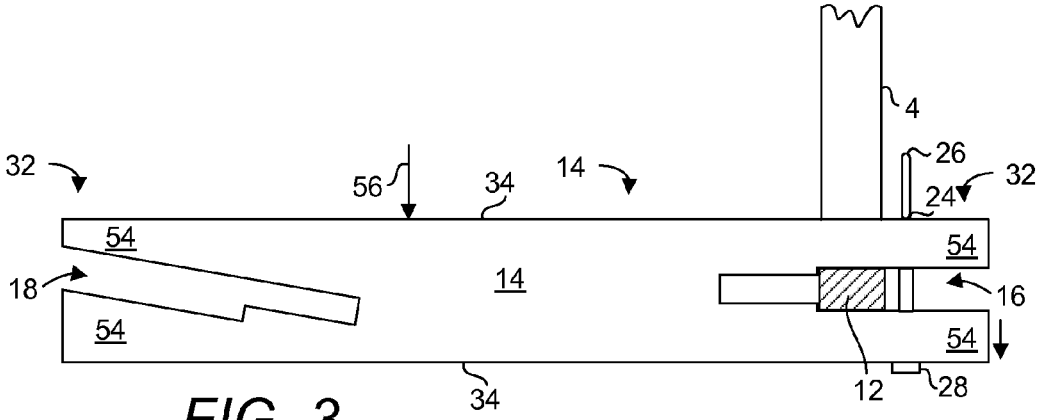
FIG. 3 is a side orthogonal view of one embodiment of the present extender, depicting the present extender positively secured to a sill step having a first cross-sectional size at a first end.

FIG. 3 is a side orthogonal view of one embodiment of the present extender, depicting the present extender positively secured to a sill step 12 having a first cross-sectional size at a first end of the step extender 14. A sill step 12 is in turn supported on a ladder 4. A sill step typically comes in two sizes, i.e., about 0.5 inch by about 2 inches and about ¾ inch by about 2.5 inches cross-sectional dimensions. FIG. 3 depicts a sill step 12 having the larger cross-sectional dimensions. The present portable railcar sill step extender 14 comprises an elongated member having two longitudinal ends 32 and two substantially parallel planes 34, a first receptacle 16 defining a set of jaws 54, a second receptacle 18 defining another set of jaws 54, at least one locking device receiver configured to receive a locking device 26. In one embodiment, the locking device receiver includes at least one aperture disposed on each of the two substantially parallel surfaces 34. A locking device and a locking device receiver are collectively called a locking mechanism. In one embodiment, the locking device 26 is available as a separate unit from the present extender 14. As will be disclosed herein, the present extender is adaptable to both undamaged and deformed sill steps.

In use, one of the first and second receptacles is aligned with a sill step to receive it and the locking device 26 is inserted through an aperture 24 at a jaw 54 of the receptacle which received the sill step and the locking device 26 is engaged with an opposingly disposed jaw 54 of the same receptacle, thereby securing the elongated member to the sill step 12 and preventing any tendency for both jaws 54 to separate while in use. The tendency to separate is especially pronounced when a large railcar worker is supported on the step extender 14 where the weight of the railcar worker is applied in direction 56 on the stepped on surface 34 of the step extender 14.

Figure 4:
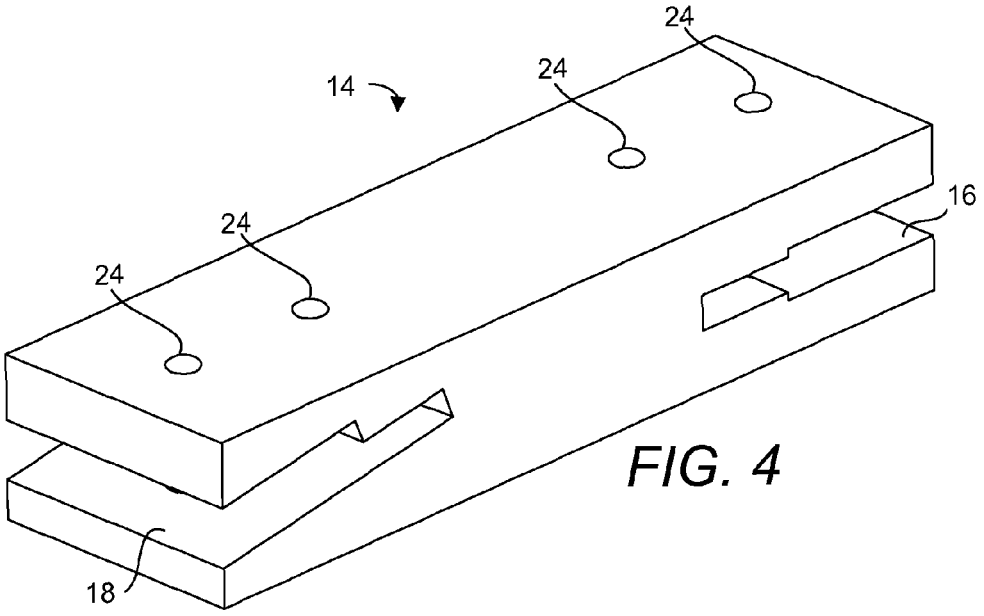
FIG. 4 is a top perspective view of one embodiment of the present extender.

FIG. 4 is a top perspective view of one embodiment of the present extender 14. In this embodiment, the step extender 14 may be constructed by removing materials of a solid block of material to form receptacles 16, 18 and apertures 24. Alternatively, the step extender 14 may be injection molded to form its present shape. Various lightweight polymeric material, e.g., nylon and metal, e.g., aluminum may be used.

Figure 5:
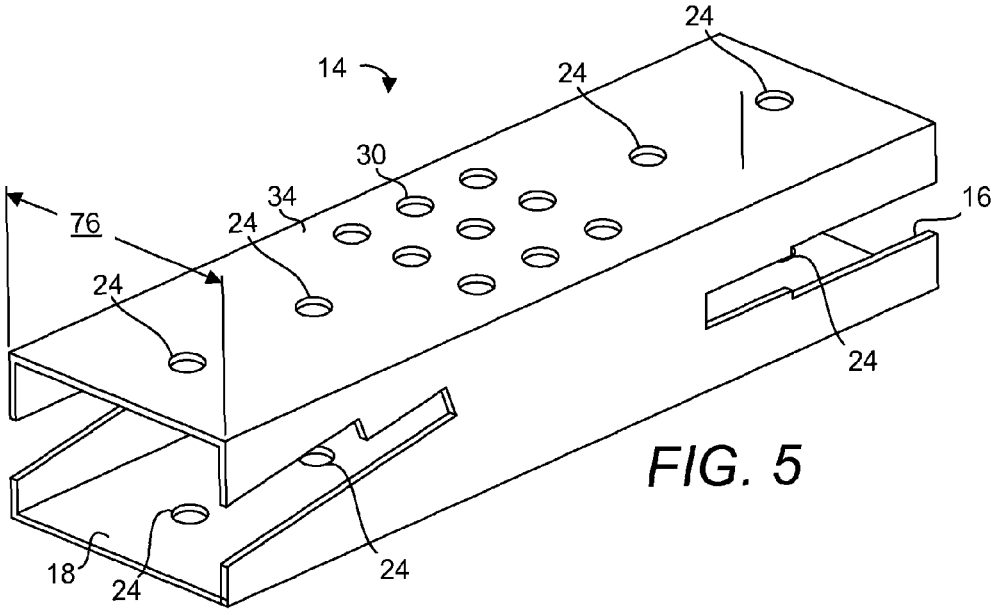
FIG. 5 is a top perspective view of another embodiment of the present extender.

FIG. 5 is a top perspective view of another embodiment of the present extender 14. In this embodiment, the step extender 14 is constructed from a section of metal, e.g. steel tube having a rectangular cross-section. A tube is first cut to length before cuts are made to each longitudinal end of the step extender 14 to form receptacles 16, 18 via common sheet metal cutting techniques. Weight saving holes 30 may also be constructed to lighten the total weight of the step extender 14 to make transporting of the step extender 14 more effortless.

Figure 6:
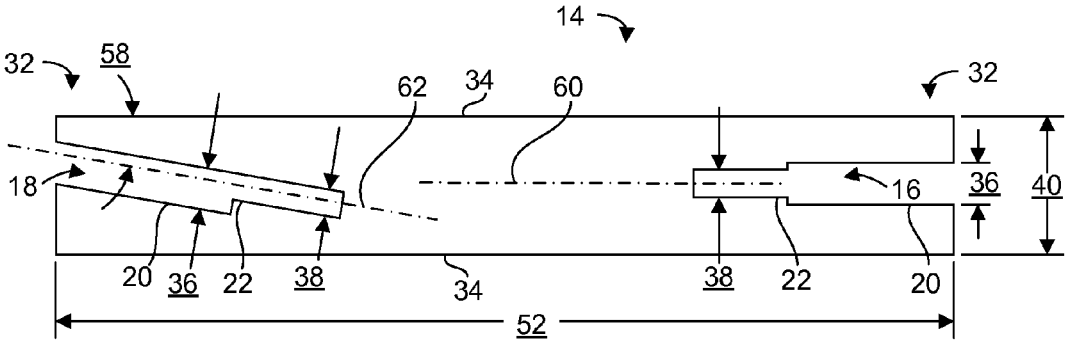
FIG. 6 is a side orthogonal view of one embodiment of the present extender, depicting critical dimensions of the present extender.

FIG. 6 is a side orthogonal view of one embodiment of the present extender, depicting critical dimensions of the present extender 14. The first receptacle 16 is disposed on a first plane 60 that is substantially parallel to surface 34. The second receptacle 18 is disposed on a second plane 62 that is disposed at angle 58 of from about 8 degrees to about 12 degrees from either one of the two substantially parallel surfaces 34. In one embodiment, angle 58 is non-zero. The length 52 of the step extender 14 preferably measures from about 20 inches to about 24 inches. The height 40 of the step extender 14 preferably measures from about 3 inches to about 4 inches. The height 36 of large slots 20 preferably measures about ¾ inch. The height 38 of small slots 22 preferably measures from about 0.5 inch. The second receptacle is preferably disposed at an angle 58 of from about 8 to about 12 degrees to each of the surfaces 34. Referring back to FIG. 5, the width 76 of a stepped on surface 34 preferably measures from about 3 inches to about 4 inches.

Figure 7:
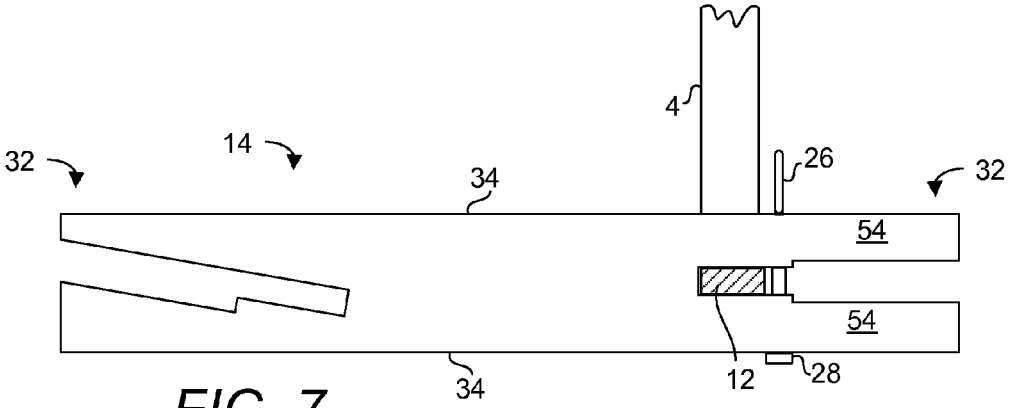
FIG. 7 is a side orthogonal view of one embodiment of the present extender, depicting the present extender being positively secured to a step having a second cross-sectional size at a first end.

FIG. 7 is a side orthogonal view of one embodiment of the present extender 14, depicting the present extender being positively secured to a step having the smaller cross-sectional dimensions at a first end. An undamaged sill step is typically aligned such that its broad surface faces upwardly to support railcar worker. Permanent deformations can occur to a sill step when it is either accidentally or on purpose, impacted with environmental features such as pylons, walls, guard rails, etc. Such deformations can cause at least a portion of a broad surface of a sill step to deviate from facing upwardly.

Figure 8:
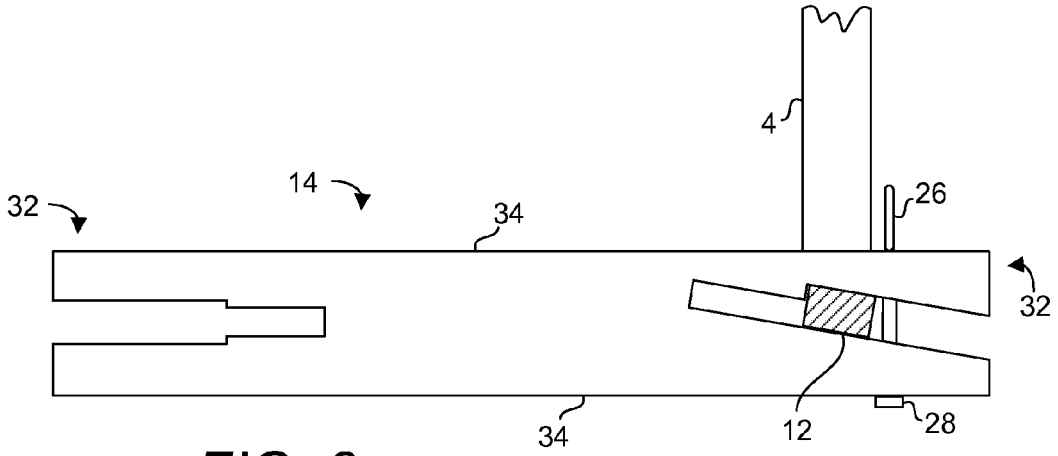
FIG. 8 is a side orthogonal view of one embodiment of the present extender, depicting the present extender being positively secured to a step having the first cross-sectional size at a second end with the slots at this end facing downwardly.
Figure 9:
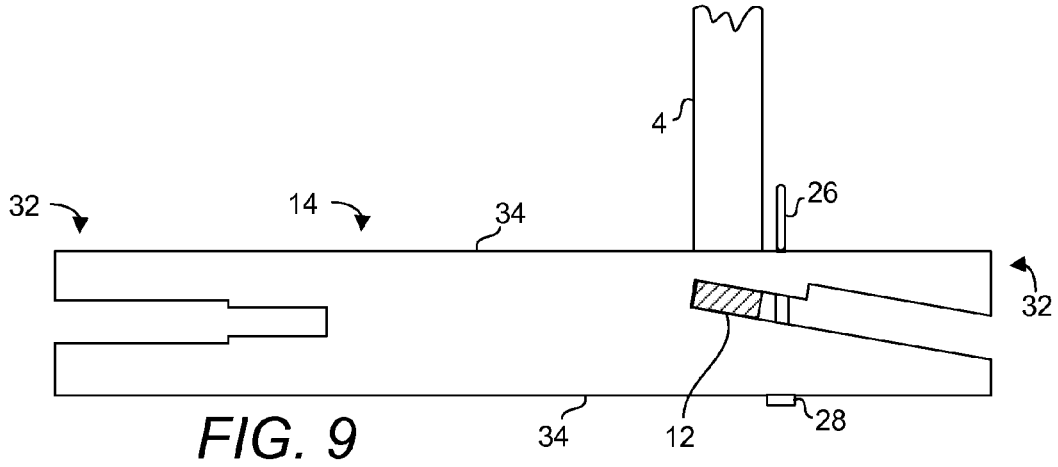
FIG. 9 is a side orthogonal view of one embodiment of the present extender, depicting the present extender being positively secured to a step having the second cross-sectional size at a second end with the slots at this end facing downwardly.

FIGS. 8 and 9 are side orthogonal views of one embodiment of the present extender, depicting the present extender being positively secured to a step having the first and second cross-sectional sizes, respectively, at a second end with the slots at this end aligned downwardly. Apertures for accommodating a locking device are preferably disposed such that upon installation, the locking device traverses or bridges a gap between the jaws 54.

Figure 10:
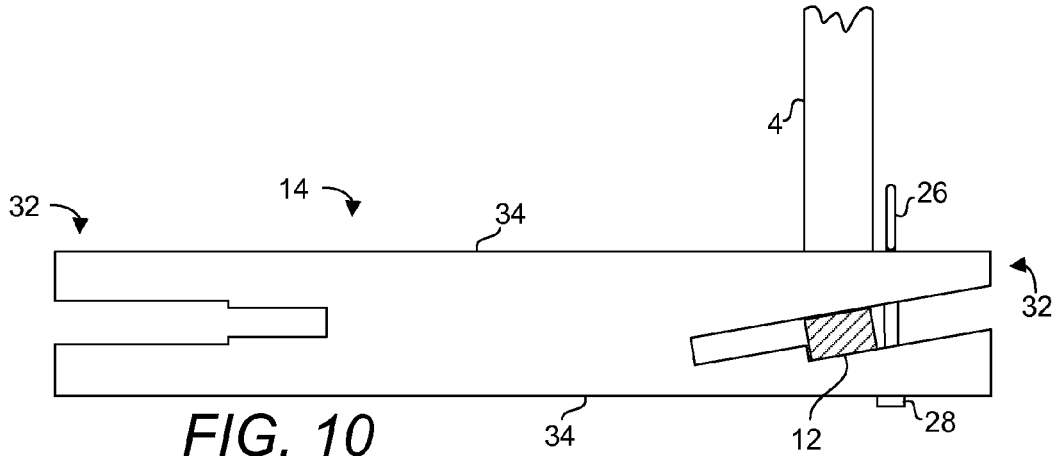
FIG. 10 is a side orthogonal view of one embodiment of the present extender, depicting the present extender being positively secured to a step having the first cross-sectional size at a second end with the slots at this end facing upwardly.
Figure 11:
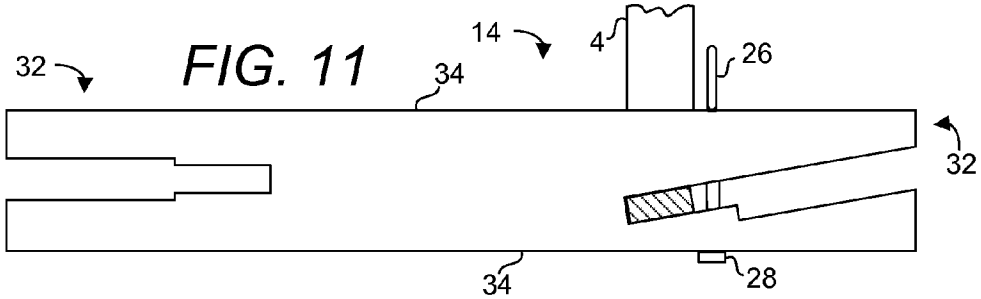
FIG. 11 is a side orthogonal view of one embodiment of the present extender, depicting the present extender being positively secured to a step having the second cross-sectional size at a second end with the slots at this end facing upwardly.

FIGS. 10 and 11 are side orthogonal views of one embodiment of the present extender, depicting the present extender being positively secured to a step having the first and second cross-sectional sizes, respectively, at a second end with the slots at this end facing upwardly. It shall be apparent that, in contrast to Barbara, the present extender 14 is adaptable to both a sill step that faces toward or away from a user. In order to adapt a present extender 14 to a sill step, a railcar worker needs only determine the stepped on surface 34 to be used such that when installed, the stepped on surface is disposed as close to a horizontal configuration as possible.

Figure 12:
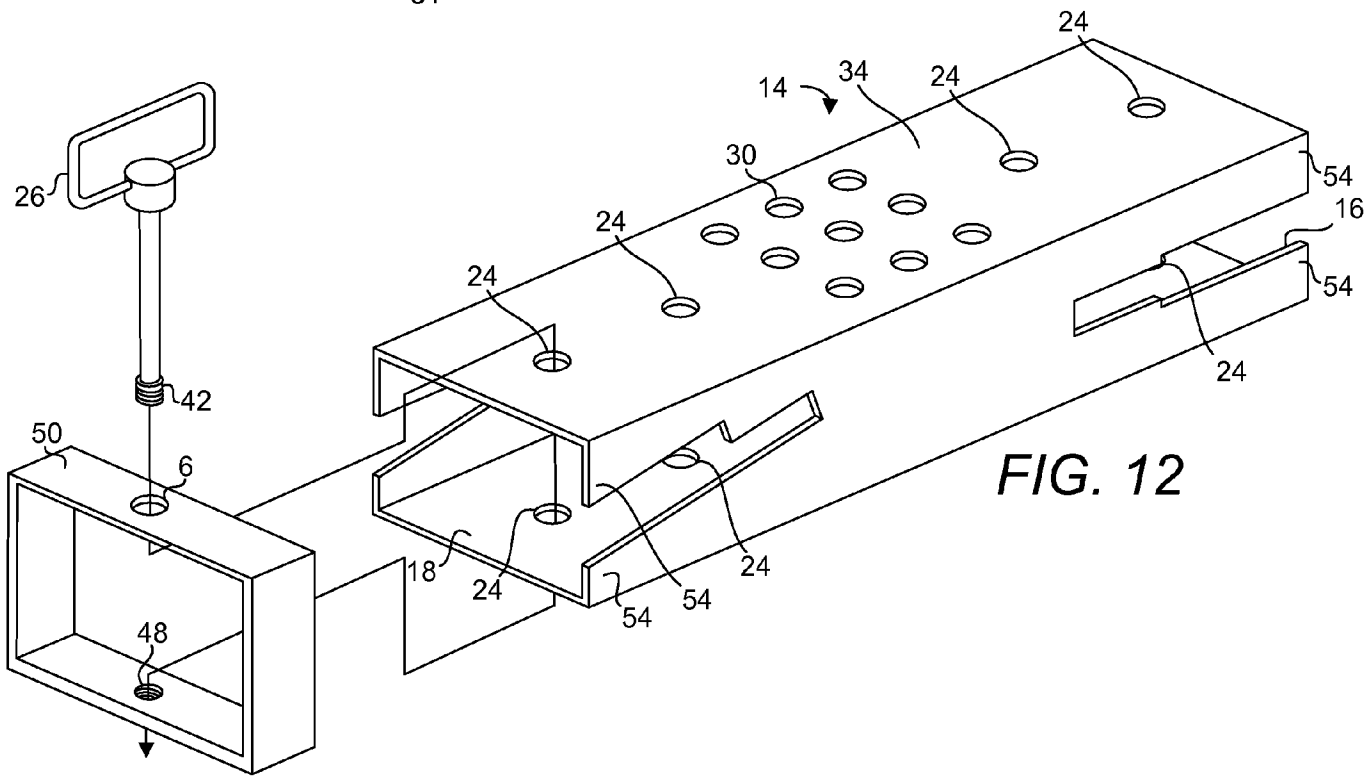
FIG. 12 is a top perspective view of one embodiment of the present extender, depicting the use of a twist handle screw and a locking ring, both of which are configured to positively lock a sill step and to prevent one end of the step from spreading when weight is applied to the step.

FIG. 12 is a top perspective view of one embodiment of the present extender, depicting the use of a twist handle screw and a locking ring 50, both of which are configured to positively lock a sill step 12 and to prevent the sill step-engaged end of the step extender 14 from spreading when weight is applied to the step extender 14. In one embodiment, the locking ring 50 is essentially a ring having a rectangular cross-section and cross-sectional area sufficiently broad to encompass each set of jaws 54 of the elongated member. The locking ring 50 includes a through aperture 6 on one bar and a threaded aperture 48 on an opposing bar. The locking ring 50 is sized suitably large to be slid over a set of jaws 54 but adequately small such that there are no excessive gaps between the locking ring 50 and the stepped on surfaces of the step. For illustration purposes, the locking ring 50 is shown to be used with the longitudinal end of the elongated member on which the second receptacle 18 is disposed. The locking ring 50 can also be used in similar fashion to the longitudinal end on which the first receptacle 16 is disposed. In use, upon inserting the second receptacle 18 in a sill step, the locking ring 50 is slid over the set of jaws 54 of the second receptacle 18 such that the through aperture 6 is aligned with the apertures 24 at the second receptacle 18. A twist handle screw 26 is inserted through the through aperture 6, the aperture 24 adjacent it on one jaw 54, the aperture 24 disposed on the opposing jaw 54. The threaded end 42 of the twist handle screw is eventually screwed into the threaded aperture 48. Upon installation, at least a portion of the handle or head of the twist handle screw 26 should come in contacting engagement with the locking ring 50, ensuring that sufficient pressure is applied to the locking ring to prevent the locked jaws 54 from spreading when a weight is applied to the stepped on surface 34.

Figure 13:
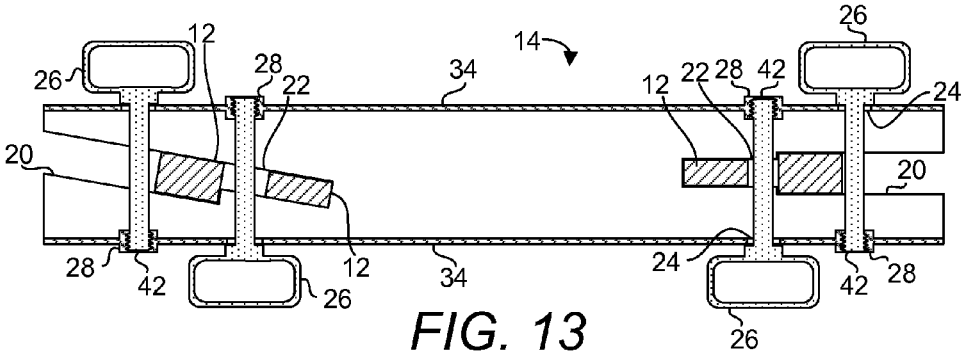
FIG. 13 is a cross-sectional side orthogonal view of one embodiment of the present extender, depicting the use of yet another embodiment of the present extender where the screw portion of the twist handle screw is received by a nut built into the present extender.

FIG. 13 is a cross-sectional side orthogonal view of one embodiment of the present extender, depicting the use of yet another embodiment of the present extender where the screw portion of the twist handle screw is received by a nut built into the present extender. In this embodiment, although less desirable than the use of a locking ring and instead of using a locking ring, a nut 28 is built into a portion of a stepped-on surface to receive the threaded end 42 of a twist handle screw. All four positions of a twist handle screw 26 are shown to depict another embodiment of the locking device receiver, i.e., a combination of a through aperture 24 and a nut 28 built into a stepped on surface 34.

Figure 14:
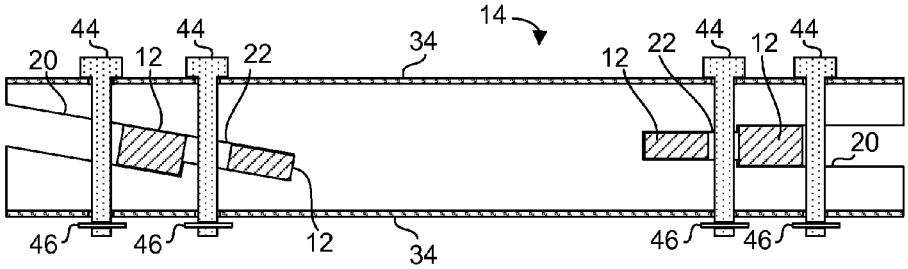
FIG. 14 is a cross-sectional side orthogonal view of one embodiment of the present extender, depicting the use of combined bolt and spring locking pin for securing the present extender to a sill step.

FIG. 14 is a cross-sectional side orthogonal view of one embodiment of the present extender, depicting the use of combined bolt and spring locking pin for securing the present extender to a sill step. Again, in this embodiment, although less desirable than the use of a locking ring and instead of using a locking ring, a bolt 44 is inserted through apertures 24, essentially bridging the two opposingly disposed stepped on surface 34 before a spring locking pin 46 is inserted through a hole in the bolt in order to prevent the bolt 44 from being pulled out of the apertures 24. All four positions of a bolt 44 are shown to depict another embodiment of the locking device i.e., a bolt 44 that is secured with a spring locking pin 46.

Figure 15:
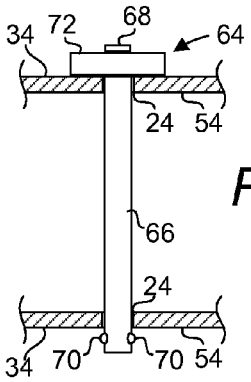
FIG. 15 depicts an alternative locking mechanism for locking each longitudinal end of a step.

FIG. 15 depicts an alternative locking mechanism for locking a set of jaws 54. Again, in this embodiment, although less desirable than the use of a locking ring and instead of using a locking ring, a quick release ball lock pin 64 is used as a single-piece locking device capable of preventing the spread of two surfaces simply by inserting the locking device through two through holes. During installation, the quick release ball lock pin 64 is grasped at its handhold 72 and the button 68 depressed such that the quick release ball lock pin 64 can be aligned with and inserted through two coaxially disposed apertures 24. Upon clearing the two through apertures 24, the button 68 is released such that the retaining balls 70 are erected, preventing the shaft 66 of the quick release back lock pin from any tendency to slide off of the apertures 24.

Figure 16:
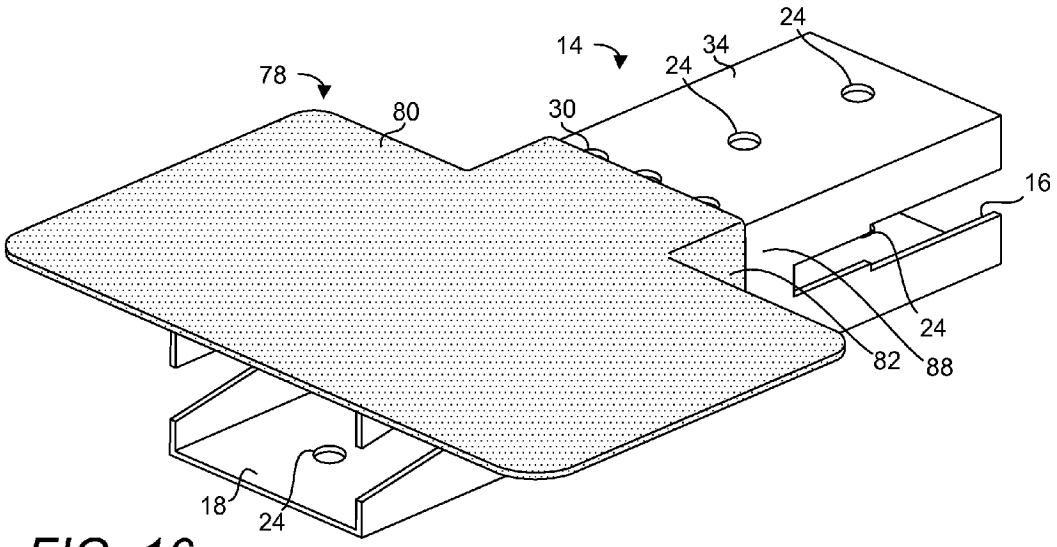
FIG. 16 is a top perspective view of one embodiment of a platform system used in conjunction with the present step extender.
Figure 17:
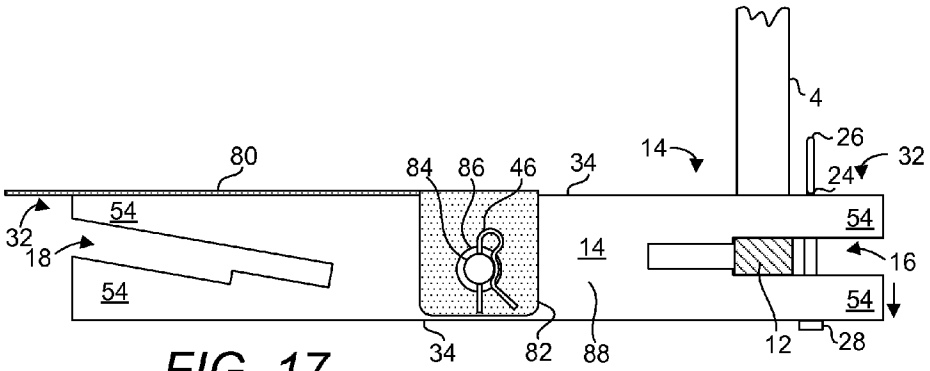
FIG. 17 is a side orthogonal view of one embodiment of a platform system used in conjunction with the present step extender where the present step extender is shown attached to a railcar ladder.

In circumstances where a user desires a larger stepped-on surface, a platform system is used. FIG. 16 is a top perspective view of one embodiment of a platform system 78 used in conjunction with the present step extender 14. FIG. 17 is a side orthogonal view of one embodiment of a platform system 78 used in conjunction with the present step extender 14 where the present step extender is shown attached to a railcar ladder. The platform system 78 includes a platform 80 connected to a pair of securing side plates 82. By disposing the securing side plates 82 on a plane away from the platform 80, the platform can be made as flat as possible without any protrusions, e.g., from fastening hardware, etc., from the surface of the platform 80. The platform system 78 may be constructed from a rectangular steel plate by making two cuts, each cut made substantially at right angle to an edge of the steel plate towards the other one of the two cuts to result in two flaps that extend away from one another. The flaps are then bent to result in side plates 82 that are disposed in substantially parallel configuration on one side of the plane within which the platform 80 is disposed. An aperture is preferably formed in each side plate 82 before the cuts were made such that when the side plates 82 have been bent to their final form, the apertures are coaxially aligned. The apertures formed on the side walls 88 of the step extender 14 allow the platform system 78 to be removably mounted to the step extender 14. Sharp corners of the formed platform 80 and side plates 82 are then rounded to avoid injuries due to accidental contact with users. In mounting the platform system 78, the side plates 82 are first aligned with mounting apertures disposed on side walls of the step extender 14. A fastener 84, e.g., a bolt is then inserted from one side of a side plate 82 through the apertures of the side plates 82 and the apertures of the side walls such that the locking end of the bolt protrudes through the second side plate 82. A washer 86 is alternatively disposed on the locking end of the bolt 84 before a spring locking pin 46 is mounted through a hole in the bolt 84 to subsequently secure the bolt 84 and hence the platform 80 to the step extender 14. The raw steel plate used for constructing the platform may be patterned to provide grip to a user. Alternatively, non-slip materials may be deposited on or attached to contact surfaces of the platform to provide grip to a user.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

I claim:

1. A portable railcar sill step extender adapted to a sill step of a railcar, said portable railcar sill step extender comprising:

(a) an elongated member having two longitudinal ends and two substantially parallel surfaces; a first receptacle having at least one slot adapted to receive the sill step, wherein said first receptacle is disposed on a first plane substantially parallel to said two substantially parallel surfaces and on one of said two longitudinal ends; a second receptacle having at least one slot adapted to receive the sill step, wherein said second receptacle is disposed on a second plane disposed at a non-zero angle to said two substantially parallel surfaces and on the other one of said two longitudinal ends and said at least one slot of said first receptacle comprises a first slot having a height of about 0.75 inch and a second slot having a height of about 0.5 inch; and (b) a locking mechanism including a bolt configured to removably connect said two substantially parallel surfaces to form a removable connection at one of said first and second receptacles upon one of said at least one slot of said first and second receptacles receiving the sill step to prevent said elongated member from sliding off of the sill step in a longitudinal direction of said elongated member once the sill step has been received in one of said first receptacle and said second receptacle.

2. The portable railcar sill step extender of claim 1, wherein said non-zero angle ranges from about 8 degrees to about 12 degrees.

3. The portable railcar sill step extender of claim 1, wherein said at least one slot of said second receptacle comprises a first slot having a height of about 0.75 inch and a second slot having a height of about 0.5 inch.

4. The portable railcar sill step extender of claim 1, wherein said elongated member further comprises at least one aperture on each of the said substantially parallel surfaces to enable removable bridging of said two substantially parallel surfaces.

5. The portable railcar sill step extender of claim 1, wherein said locking mechanism comprises a twist handle screw-locking ring combination.

6. The portable railcar sill step extender of claim 1, wherein said locking mechanism comprises a spring locking pin-bolt combination.

7. The portable railcar sill step extender of claim 1, wherein said locking mechanism comprises a quick release ball lock pin.

8. The portable railcar sill step extender of claim 1, further comprising a locking ring configured to removably encompass one of said two longitudinal ends of said elongated member in order to prevent the spread of said two substantially parallel surfaces in a direction away from one another.

9. The portable railcar sill step extender of claim 1, wherein said elongated member further comprises a pair of side walls and said portable railcar sill step extender further comprises a platform system including a platform and a pair of side plates disposed at a substantially right angle to said platform, wherein said pair of side plates is configured for removable attachment to said pair of side walls.

10. A portable railcar sill step extender adapted to a sill step of a railcar, said portable railcar sill step extender comprising:

(a) an elongated member having two longitudinal ends and two substantially parallel surfaces; a first receptacle having at least one slot adapted to receive the sill step, wherein said first receptacle is disposed on a first plane substantially parallel to said two substantially parallel surfaces and on one of said two longitudinal ends; a second receptacle having at least one slot adapted to receive the sill step, wherein said second receptacle is disposed on a second plane disposed at from about 8 degrees to about 12 degrees from said two substantially parallel surfaces and on the other one of said two longitudinal ends; and (b) a locking mechanism including a bolt configured to removably connect said two substantially parallel surfaces to form a removable connection at one of said first and second receptacles upon one of said at least one slot of said first and second receptacles receiving the sill step to prevent said elongated member from sliding off of the sill step in a longitudinal direction of said elongated member once the sill step has been received in one of said first receptacle and said second receptacle.

11. The portable railcar sill step extender of claim 10, wherein said at least one slot of said first receptacle comprises a first slot having a height of about 0.75 inch and a second slot having a height of about 0.5 inch.

12. The portable railcar sill step extender of claim 10, wherein said at least one slot of said second receptacle comprises a first slot having a height of about 0.75 inch and a second slot having a height of about 0.5 inch.

13. The portable railcar sill step extender of claim 10, said elongated member further comprises at least one aperture on each of the said substantially parallel surfaces to enable removable bridging of said two substantially parallel surfaces.

14. The portable railcar sill step extender of claim 10, wherein said locking mechanism comprises a twist handle screw-locking ring combination.

15. The portable railcar sill step extender of claim 10, wherein said locking mechanism comprises a spring locking pin-bolt combination.

16. The portable railcar sill step extender of claim 10, wherein said locking mechanism comprises a quick release ball lock pin.

17. The portable railcar sill step extender of claim 10, further comprising a locking ring configured to removably encompass one of said two longitudinal ends of said elongated member in order to prevent the spread of said two substantially parallel surfaces in a direction away from one another.

18. The portable railcar sill step extender of claim 10, wherein said elongated member further comprises a pair of side walls and said portable railcar sill step extender further comprises a platform system including a platform and a pair of side plates disposed at substantially right angle to said platform, wherein said pair of side plates is configured for removable attachment to said pair of side walls.

19. A portable railcar sill step extender adapted to a sill step of a railcar, said portable railcar sill step extender comprising:

(a) an elongated member having two longitudinal ends and two substantially parallel surfaces; a first receptacle having at least one slot adapted to receive the sill step, wherein said first receptacle is disposed on a first plane substantially parallel to said two substantially parallel surfaces and on one of said two longitudinal ends; a second receptacle having at least one slot adapted to receive the sill step, wherein said second receptacle is disposed on a second plane disposed at from about 8 degrees to about 12 degrees from said two substantially parallel surfaces and on the other one of said two longitudinal ends; wherein any one of said at least one slot of said first receptacle and said at least one slot of said second receptacle comprises a first slot and a second slot and said first slot includes a height of about 0.75 inch and said second slot includes a height of about 0.5 inch; and (b) a locking mechanism including a bolt configured to removably connect said two substantially parallel surfaces to form a removable connection at one of said first and second receptacles upon one of said at least one slot of said first and second receptacles receiving the sill step to prevent said elongated member from sliding off of the sill step in a longitudinal direction of said elongated member once the sill step has been received in one of said first receptacle and said second receptacle.

* * * * *